US007026904B2

(12) United States Patent
Gomez et al.

(10) Patent No.: US 7,026,904 B2
(45) Date of Patent: Apr. 11, 2006

(54) MULTIPLE LAYER INDUCTOR AND METHOD OF MAKING THE SAME

(75) Inventors: Ramon A. Gomez, San Juan Capistrano, CA (US); Lawrence M. Burns, Laguna Hills, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 11/031,072

(22) Filed: Jan. 10, 2005

(65) Prior Publication Data

US 2005/0116802 A1 Jun. 2, 2005

Related U.S. Application Data

(63) Continuation of application No. 09/981,993, filed on Oct. 19, 2001, now Pat. No. 6,847,282.

(51) Int. Cl.
*H01F 5/00* (2006.01)

(52) U.S. Cl. ..... 336/200; 336/84 R; 336/84 C; 333/185

(58) Field of Classification Search ..... 336/84 R, 336/84 C, 200, 232; 333/175, 185, 204
See application file for complete search history.

(56) References Cited

U.S. PATENT DOCUMENTS

| | | | | |
|---|---|---|---|---|
| 5,039,964 | A * | 8/1991 | Ikeda | 333/181 |
| 5,515,022 | A | 5/1996 | Tashiro et al. | |
| 5,612,660 | A | 3/1997 | Takimoto | |
| 5,942,965 | A * | 8/1999 | Kitamura et al. | 336/200 |
| 6,147,571 | A * | 11/2000 | Kitazawa et al. | 333/126 |
| 6,448,873 | B1 * | 9/2002 | Mostov | 333/185 |
| 6,816,032 | B1 * | 11/2004 | Gaynor et al. | 333/175 |
| 2003/0117234 | A1 * | 6/2003 | Shingaki et al. | 333/175 |

FOREIGN PATENT DOCUMENTS

| | | |
|---|---|---|
| EP | 0 991 088 A1 | 4/2000 |
| EP | 1 008 997 A1 | 6/2000 |
| JP | 62-152111 | 7/1987 |

OTHER PUBLICATIONS

Copy of Partial European Search Report from European Patent Appl. No. 02257226.7-2208, 4 pages (Feb. 7, 2003).
Abstract for Japanese Publication No. 04103209, Patent Abstracts of Japan, European Patent Office, 1 page (Date of publication of application—Apr. 6, 1992).
Lee, T.H., The Design of CMOS Radio-Frequency Integrated Circuits, Cambridge University Press, pp. 48-49 (1998).
Wheeler, H.A., "Simple Inductance Formulas for Radio Coils," Proceedings of the Institute of Radio Engineers, vol. 16, No. 1, pp. 1398-1400 (Oct. 1928).

* cited by examiner

*Primary Examiner*—Tuyen T Nguyen
(74) *Attorney, Agent, or Firm*—Sterne Kessler Goldstein Fox PLLC

(57) ABSTRACT

A multiple layer inductor has a first spiral conductive pattern disposed on a first surface; a second spiral conductive pattern disposed on a second surface; a continuing interconnection coupled to the first and second spiral conductive patterns; an interface coupled to the first and second spiral conductive patterns; and a conductive shield pattern disposed on a third surface that is adjacent to the second surface. The interface includes a first terminal disposed on the first surface that is coupled to the first spiral conductive pattern. The interface also includes a second terminal that is disposed on the first surface and coupled to said second spiral conductive pattern.

15 Claims, 17 Drawing Sheets

MULTIPLE LAYER INDUCTOR AND METHOD OF MAKING THE SAME

CROSS REFERENCE TO RELATED APPLICATIONS

This application is a continuation of U.S. application Ser. No. 09/981,993, filed Oct. 19, 2001, now U.S. Pat. No. 6,847,282 entitled "Multiple Layer Inductor and Method of Making the Same", which is incorporated herein by reference in its entirety.

BACKGROUND OF THE INVENTION

1. Field of the Invention

The present invention relates generally to electronic components, such as inductors. More particularly, the present invention relates to printed multiple layer inductors.

2. Background Art

Inductor implementations can be generally classified into two categories: discrete inductors and printed inductors. Discrete inductors (e.g., leaded inductors, surface mounted inductors, and air coil inductors) are generally packaged in containers having terminals that connect to a substrate, such as a printed circuit board (PCB). In contrast, printed inductors are not packaged in a container. Rather, printed inductors include patterns of conductive material disposed on a substrate, such as a PCB.

Because the integration of discrete inductors onto a PCB requires expensive assembly techniques, electronic products having discrete inductors are more costly than ones having printed inductors.

Therefore, to minimize the cost of products requiring inductors, it is desirable to use printed inductors. Unfortunately, the replacement of discrete inductors with less expensive printed inductors typically requires a tradeoff in size. This tradeoff occurs for two reasons. First, typical printed inductors must be considerably larger than their discrete inductor counterparts to provide the same inductance value. Second, printed inductors are typically unshielded. As a consequence, minimizing electromagnetic interaction between conventional printed inductors and other electronic components (such as other inductors) requires these printed inductors to be spaced at greater distances from other electronic components.

Multiple layer approaches have been employed for printed inductors. One such approach is shown in FIGS. 1A–1B and FIG. 2. As shown in FIGS. 1A–1B, this approach involves two spiral layers 102*a* and 102*b*, where each spiral layer 102 is printed on a respective side of a glass-epoxy substrate. The inductor has terminals 112 and 114, which are printed on one of the substrate sides.

Printed ground planes 104*a* and 104*b* provide shielding to spiral patterns 102*a* and 102*b*, respectively. These ground planes are connected by apertures known as vias, such as via 106, that penetrate the substrate. As shown in FIGS. 1A and 1B, vias 108 and 110 connect spirals 102*a* and 102*b*.

According to the approach of FIGS. 1A–1B, and 2, the substrate is attached to an aluminum housing or base. FIG. 2 is a side view illustrating the attachment of the substrate (shown as substrate 201) to an aluminum housing 202 having a portion that is aligned with spirals 102. Substrate 201 and housing 202 are attached with a screw 202 that penetrates ground planes 104*a* and 104*b*, thereby grounding housing 202. Thus, the aligned portion of housing 202 provides further shielding (referred to herein as bottom shielding) to spiral patterns 102.

Unfortunately, housing 202 is expensive and bulky. Accordingly, what is needed is a printed inductor implementation that provides inductance values and shielding capabilities that are comparable to discrete inductors without requiring a bulky and expensive housing.

BRIEF SUMMARY OF THE INVENTION

The present invention is directed to a multiple layer inductor having a first spiral conductive pattern disposed on a first surface; a second spiral conductive pattern disposed on a second surface; a continuing interconnection coupled to the first and second spiral conductive patterns; an interface coupled to the first and second spiral conductive patterns; and a conductive shield pattern disposed on a third surface that is adjacent to the second surface.

The interface includes a first terminal disposed on the first surface that is coupled to the first spiral conductive pattern. The interface also includes a second terminal that is disposed on the first surface and coupled to the second spiral conductive pattern.

The continuing interconnection may include a first via coupled to the first and second spiral conductive patterns; and a second via coupled to the second spiral conductive pattern and the interface.

Alternatively, the continuing interconnection may include a first via coupled to the first spiral conductive pattern; a second via coupled to the second spiral conductive pattern; and a third spiral conductive pattern disposed on a fourth surface that is coupled to the first and second vias.

In a further alternative, the continuing interconnection may include a first via coupled to the first spiral conductive pattern; a second via coupled to the second spiral conductive pattern; and a plurality of connected spiral conductive patterns that are each disposed on a respective one of a plurality of adjacent layers. In this alternative, a first of the plurality of spiral conductive patterns is coupled to the first via, and a second of the plurality of spiral conductive patterns is coupled to the second via.

The spiral conductive patterns may have various orientations according to various schemes. In one such scheme, orientations alternate according to adjacent substrate surfaces.

The multiple layer inductor may also include a second conductive shield pattern disposed on a fourth surface that is adjacent to the first surface. Furthermore, the multiple layer inductor may include first and second conductive side shield patterns that are disposed on the first and second layers, respectively. These shield patterns may be grounded.

The present invention is also directed to a method of designing a multiple layer spiral inductor having a plurality of spiral conductive patterns disposed on corresponding substrate surfaces. This method includes defining spatial characteristics for each of the spiral conductive patterns; determining the number of spiral conductive patterns; calculating the number of turns for each of the spiral conductive patterns; and selecting a spiral shape for each of the spiral conductive patterns.

The present invention advantageously enables the replacement of costly discrete inductors with less expensive printed inductors. This replacement may occur without an increase in inductor footprint sizes.

BRIEF DESCRIPTION OF THE FIGURES

The present invention will be described with reference to the accompanying drawings. In the drawings, like reference numbers generally indicate identical, functionally similar, and/or structurally similar elements. The drawing in which an element first appears is indicated by the leftmost digit(s) in the reference number.

DETAILED DESCRIPTION OF THE INVENTION

I. Introduction

Electronic products are typically implemented on substrates, such as PCBs, that have one or more layers. Each of these layers includes a non-conductive surface upon which electronic components and traces (also referred to herein as conductive routing) may be disposed. Traces are patterns of conductive material, such as copper, disposed on a non-conductive substrate surface that provide electrical interconnections between electronic components. In addition to providing interconnectivity, traces may provide electromagnetic shielding to electronic components and their interconnections.

A substrate may support various types of electronic components. Two such component types are printed components and discrete components. Printed components are created through the integration of a material with one or more substrate surfaces in a specified pattern. An exemplary printed component material includes conductors for the creation of components such as resistors, capacitors, and inductors. Further exemplary materials include dielectrics for the creation of components such as capacitors and transmission lines.

Printed components may be placed on a substrate surface through various techniques. In one such technique, a substrate surface is first covered with a material layer, such as a conductive metal. Next, through chemical reduction processes and or mechanical routing, undesired portions of this material layer are etched away. This etching results in one or more printed electronic components being disposed on the substrate surface. In other printing techniques, components are formed through the use of materials, such as conductive inks and solder flux.

In contrast to printed components, which are created through an integration process with one or more substrate surfaces, the assembly of discrete components does not require a substrate. Examples of discrete components include leaded components, surface mounted components, and integrated circuits (ICs). Discrete components have terminals that attach to metal traces on a substrate. The attachment of these terminals is performed through techniques, such as soldering.

Figure 1A:
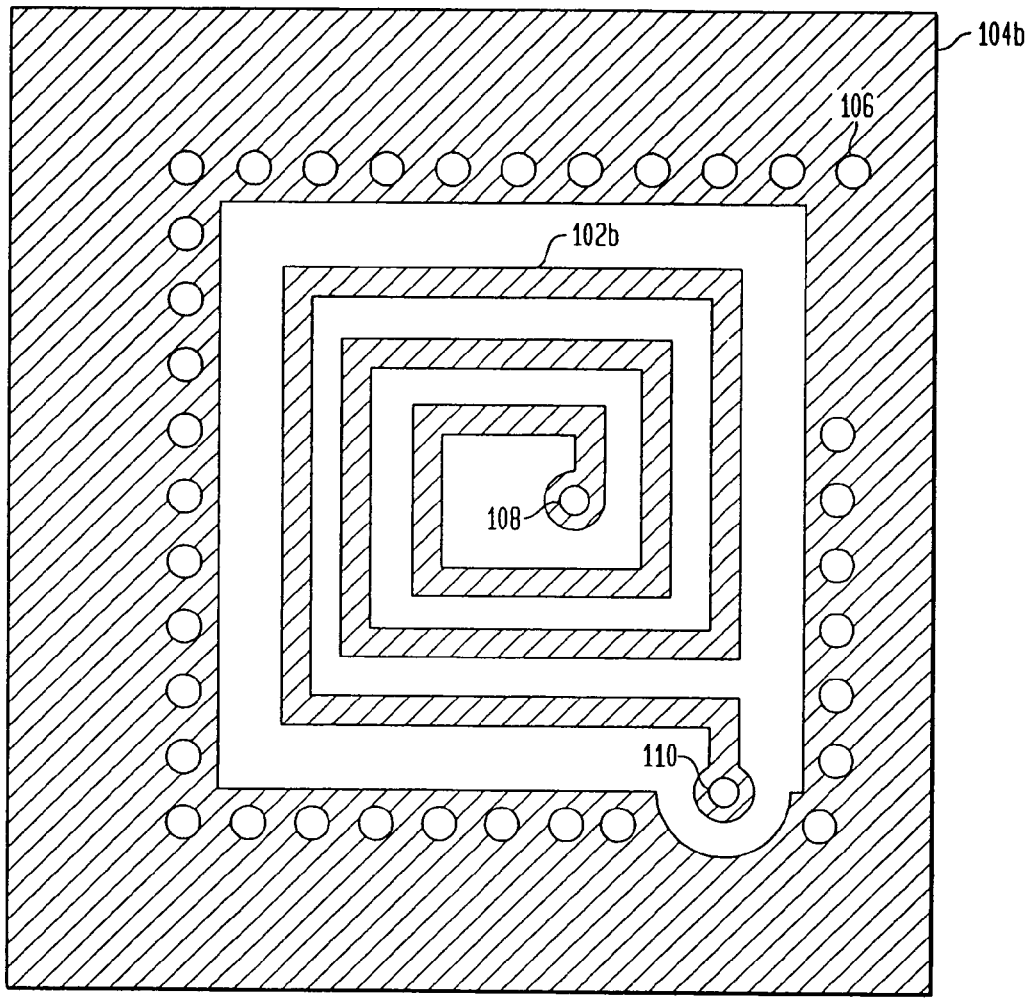
FIGS. 1A and 1B are views of printed inductor patterns.
Figure 1B:
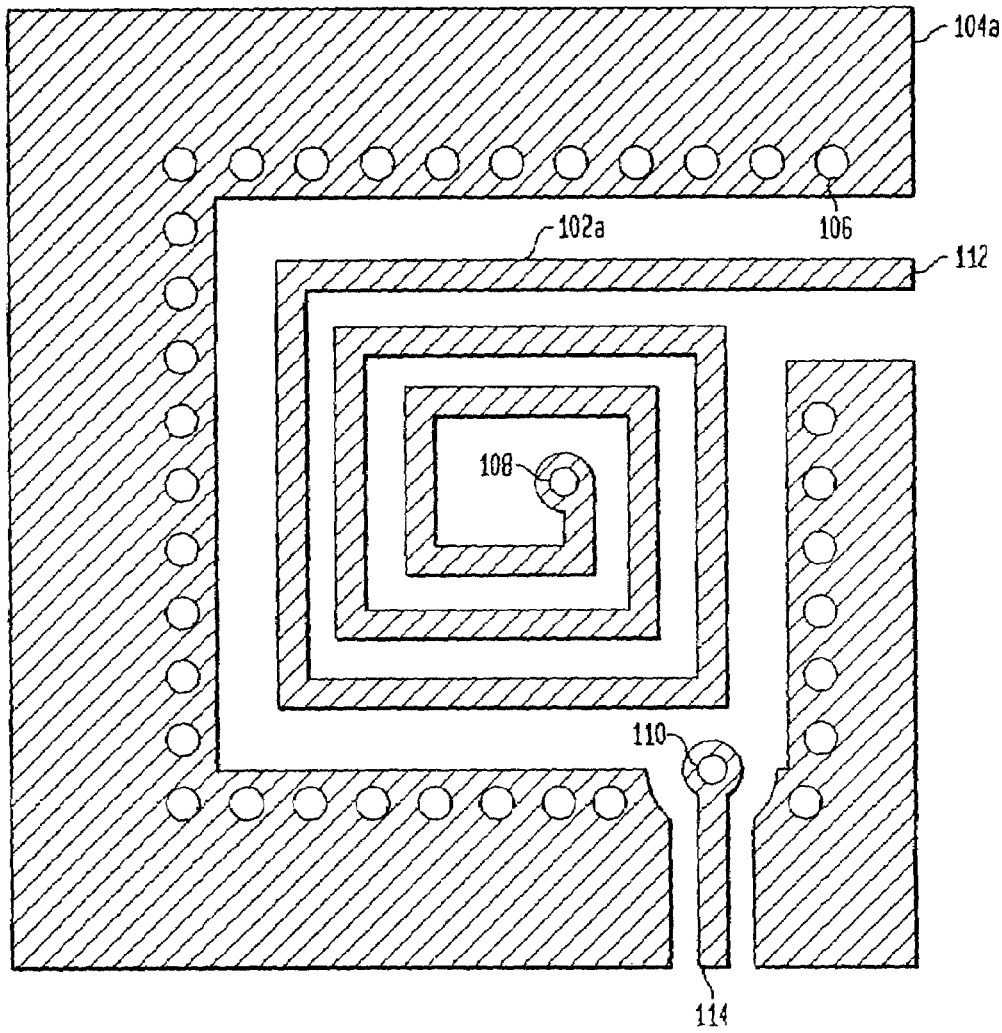
Figure 2:
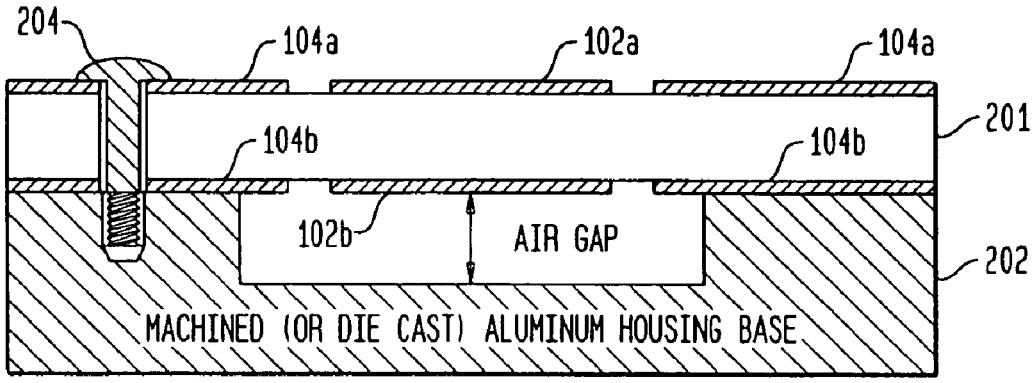
FIG. 2 is a view of a substrate attached to an aluminum housing.
Figure 3:
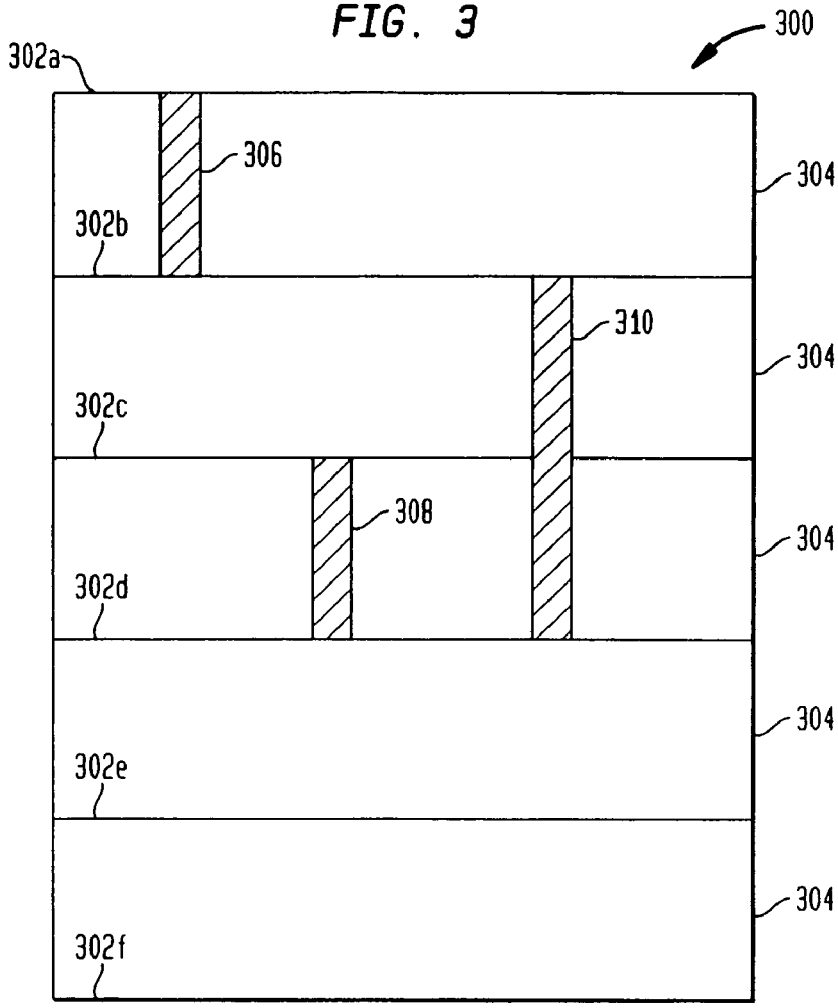
FIG. 3 is a view of an exemplary multiple layer substrate.

As described above, many substrates include a plurality of surfaces. These surfaces may be arranged in a layered pattern. FIG. 3 is a side view of an exemplary multiple layer substrate 300 having surfaces 302*a* through 302*f*. In such multi-layer arrangements, pairings of adjacent surfaces (e.g., surfaces 302*b* and 302*c*) are each separated by a non-conductive material(s) 304, such as epoxy-glass composite. Multi-layer substrates have outer surface layers and one or more inner surface layers. Outer surface layers are adjacent to only one other surface layer. The exemplary substrate of FIG. 3 includes outer layers 302*a* and 302*f*. In contrast, for each inner surface layer, there are two adjacent surface layers. The exemplary substrate of FIG. 3 includes inner layers 302*b*, 302*c*, 302*d*, and 302*e*.

Multi-layer substrates, such as the exemplary substrate shown in FIG. 3, may provide for the interconnection of components supported by different layers. Such interconnections are supported by vias. Vias are apertures that penetrate one or more substrate surfaces and contain conductive material to provide electrical interconnections between components disposed on two or more substrate surfaces.

The substrate of FIG. 3 illustrates vias 306, 308, and 310. Vias 306 and 308 each provide for interconnections between components disposed on two surfaces. As shown in FIG. 3, via 306 provides for an interconnection between components disposed on surfaces 302*a* and 302*b*, while via 308 provides for an interconnection between components disposed on surfaces 302*c* and 302*d*. In contrast, via 310 provides for an interconnection between components disposed on three surfaces (i.e., surfaces 302*b*, 302*c* and 302*d*).

II. Printed Inductors

Figure 4:
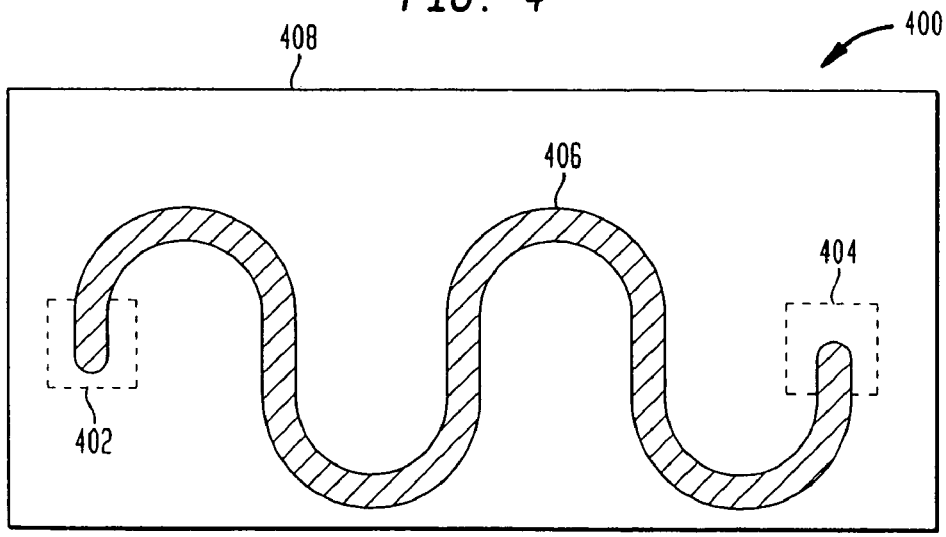
FIG. 4 is a view of a meander line inductor.

As described above, conventional printed inductors employ a single layer approach. FIG. 4 is a top view of an exemplary single layer inductor 400. Single layer inductor 400 includes a conductive trace 406 having a meander pattern. At each end of conductive trace 406 are terminals 402 and 404, respectively. These terminals provide areas for the interconnection of inductor 400 with other electronic components (not shown).

Single layer inductor 400 requires a surface area on a single substrate surface that is shown in FIG. 4 as a footprint 408. As set forth above, single layer printed inductors have the disadvantage of requiring large footprints.

Figure 5:
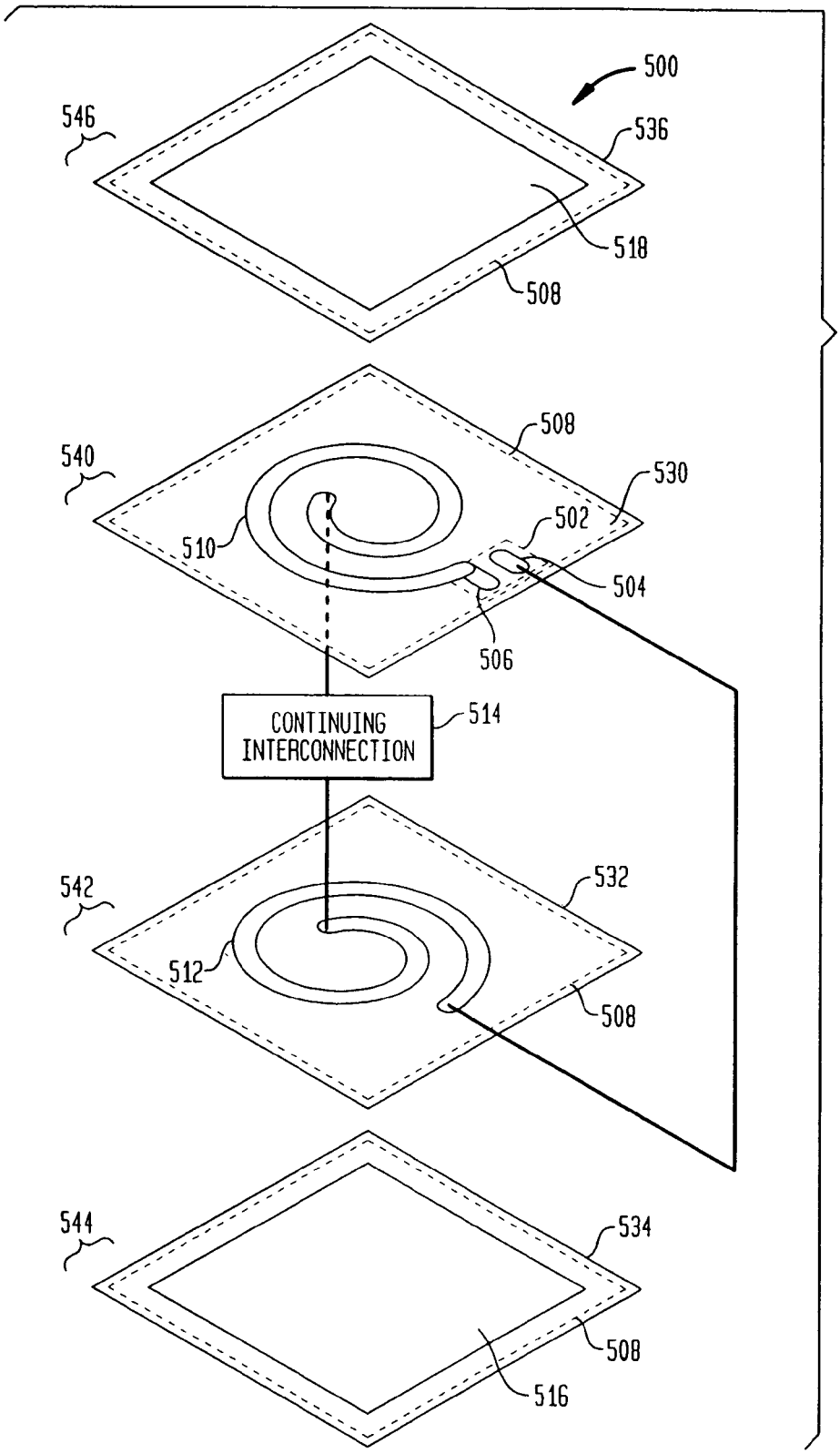
FIG. 5 is an illustration of a multiple layer inductor.

FIG. 5 is an illustration of a multiple layer inductor 500 that advantageously enables smaller footprint implementations. Multiple layer inductor 500 is implemented on a substrate having a plurality of layers that each have a corresponding surface. As shown in FIG. 5, this multiple layer substrate has a first surface 530 that corresponds to a first layer 540, a second surface 532 that corresponds to a second layer 542, and a third surface 534 that corresponds to a third layer 544.

Inductor 500 includes a first spiral conductive pattern 510, a second spiral conductive pattern 512, a continuing interconnection 514, an interface 502, an optional conductive bottom shield pattern 516, and an optional conductive top shield pattern 518.

Spiral conductive pattern 510 and interface 502 are both disposed on first surface 530. Interface 502 includes a first terminal 504 and a second terminal 506. Spiral conductive pattern 510 is electrically coupled to second terminal 506 and continuing interconnection 514. Terminals 502 and 504, as well as conductive pattern 510 include conductive material(s) that are disposed on surface 530 through a printing process.

Spiral conductive pattern 512 is disposed on second surface 532. Spiral conductive pattern 512 is electrically coupled to first terminal 504 and continuing interconnection 514. Like first spiral conductive pattern 510, second spiral conductive pattern 512 includes conductive material(s) that are disposed on surface 530 through a printing process.

Continuing interconnection 514 provides an electrical interconnection between spiral conductive patterns 510 and 512. In addition, continuing interconnection 514 may also provide additional spiral conductive patterns. Various implementations of continuing interconnection 514 are described below in greater detail with reference to FIGS. 6A–8.

Conductive bottom shield pattern 516 is disposed on third surface 534. Surface 534 is adjacent to surface 532. Shield pattern 516 has a voltage potential, such as ground. Shield pattern 516 provides a shielding function that reduces unwanted electromagnetic interaction between inductor 500 and other electronic components (not shown).

Conductive top shield pattern 518 is disposed on fourth surface 536. Surface 536, which corresponds to a layer 546, is adjacent to surface 530. Shield pattern 518 has a voltage potential, such as ground. Shield pattern 518 provides a shielding function that reduces unwanted electromagnetic interaction between inductor 500 and other electronic components (not shown).

The aforementioned elements of multiple layer inductor 500 are within a footprint 508. FIG. 5 shows footprint 508 as a surface area projected onto each of surfaces 530, 532, 534, and 536. Footprint 508 is smaller than footprints associated with conventional single layer inductors.

Figure 6A:
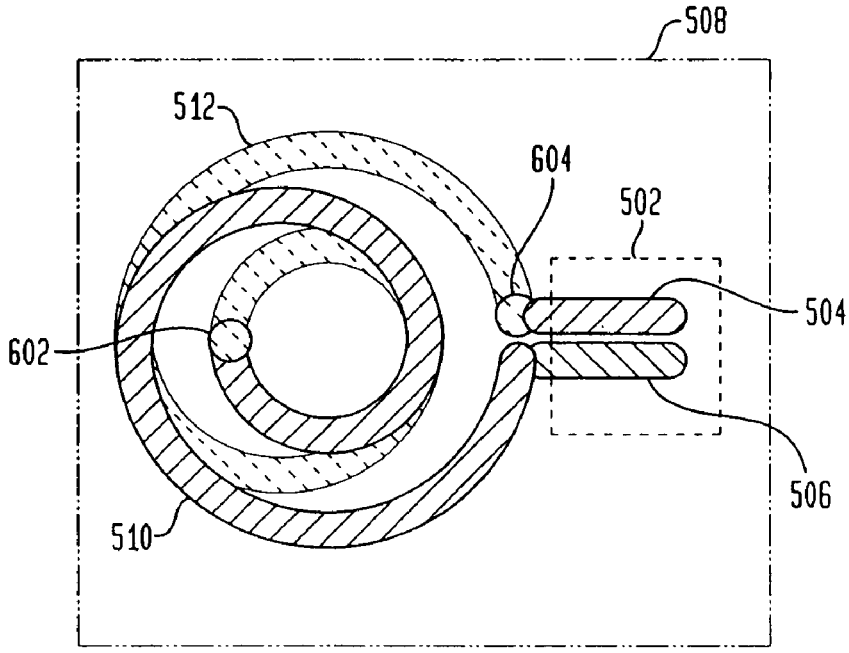
FIGS. 6A and 6B are views of a three layer spiral inductor implementation.
Figure 6B:
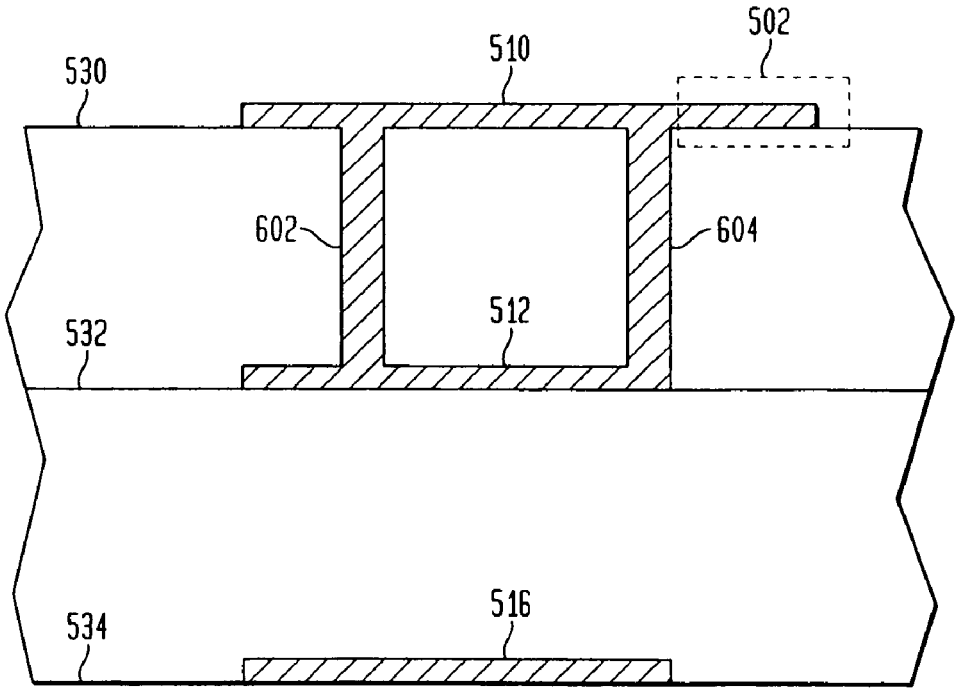

The description now turns to various exemplary implementations of multiple layer inductor 500. FIGS. 6A and 6B are views of a three layer implementation of spiral inductor 500. In this implementation, continuing interconnection 514 includes a first via 602 and a second via 604. FIG. 6A, which is a top view, illustrates that first via 602 provides a connection between first conductive pattern 510 and second conductive pattern 512. FIG. 6A also shows that second via 604 electrically couples second conductive pattern 512 with first terminal 504 of interface 502.

FIG. 6B is a side view of this three layer implementation that illustrates the relationship of inductor 500 components to surfaces in a multiple layer substrate. As shown in FIG. 6B, first conductive pattern 510 and interface 502 are disposed on first surface 530. First via 602 provides an electrical coupling between first conductive pattern 510 and second conductive pattern 512. Second via 604 provides an electrical coupling between second spiral conductor 512 and first terminal 504.

Shield pattern 516 is disposed on third surface 534, which is adjacent to surface 532. Shield pattern 516 is substantially aligned with second conductive pattern 512.

Implementations of multiple layer inductor 500 may include additional spiral conductive patterns. Accordingly, FIGS. 7 and 8 are views of an exemplary multiple layer inductor 500 implementation where continuing interconnection 514 includes multiple spiral conductive patterns.

Figure 7:
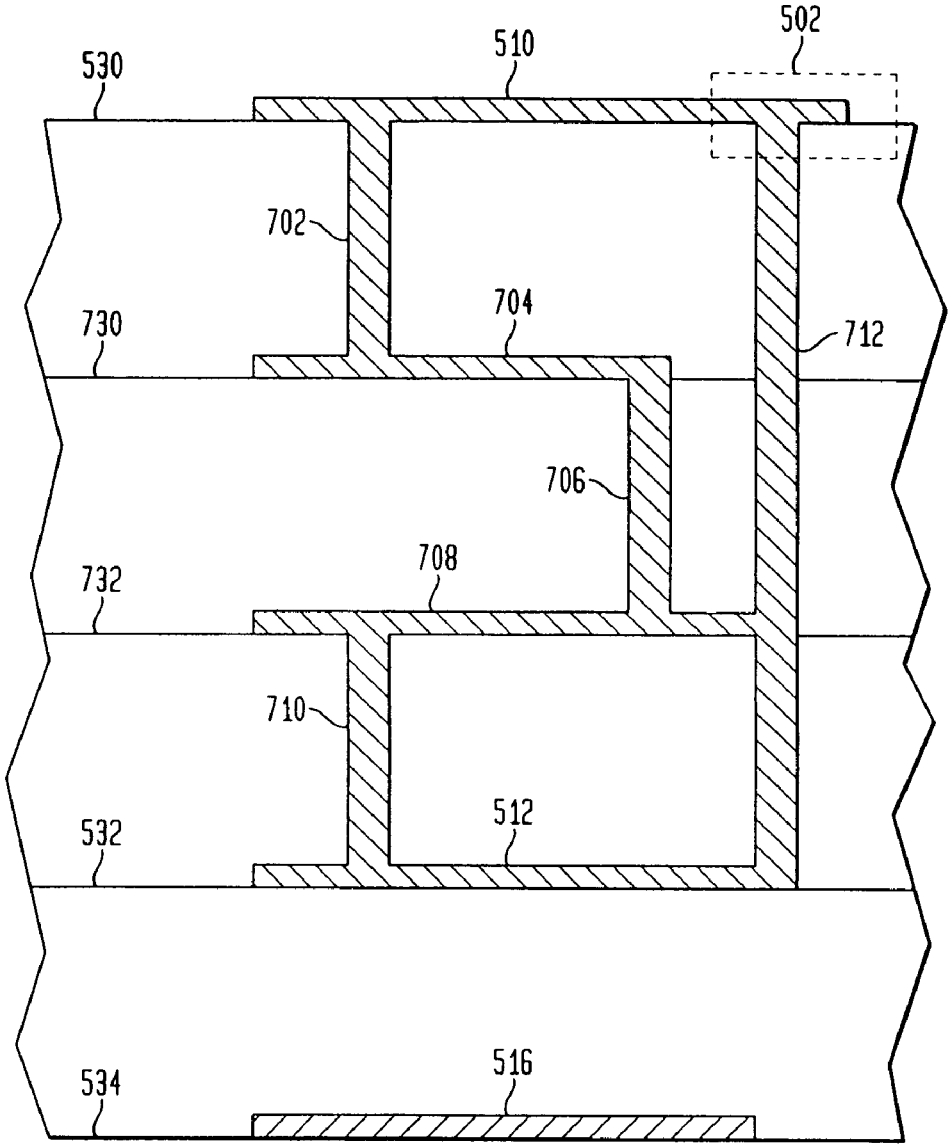
FIGS. 7 an 8 are views of a five layer spiral inductor implementation.
Figure 8:
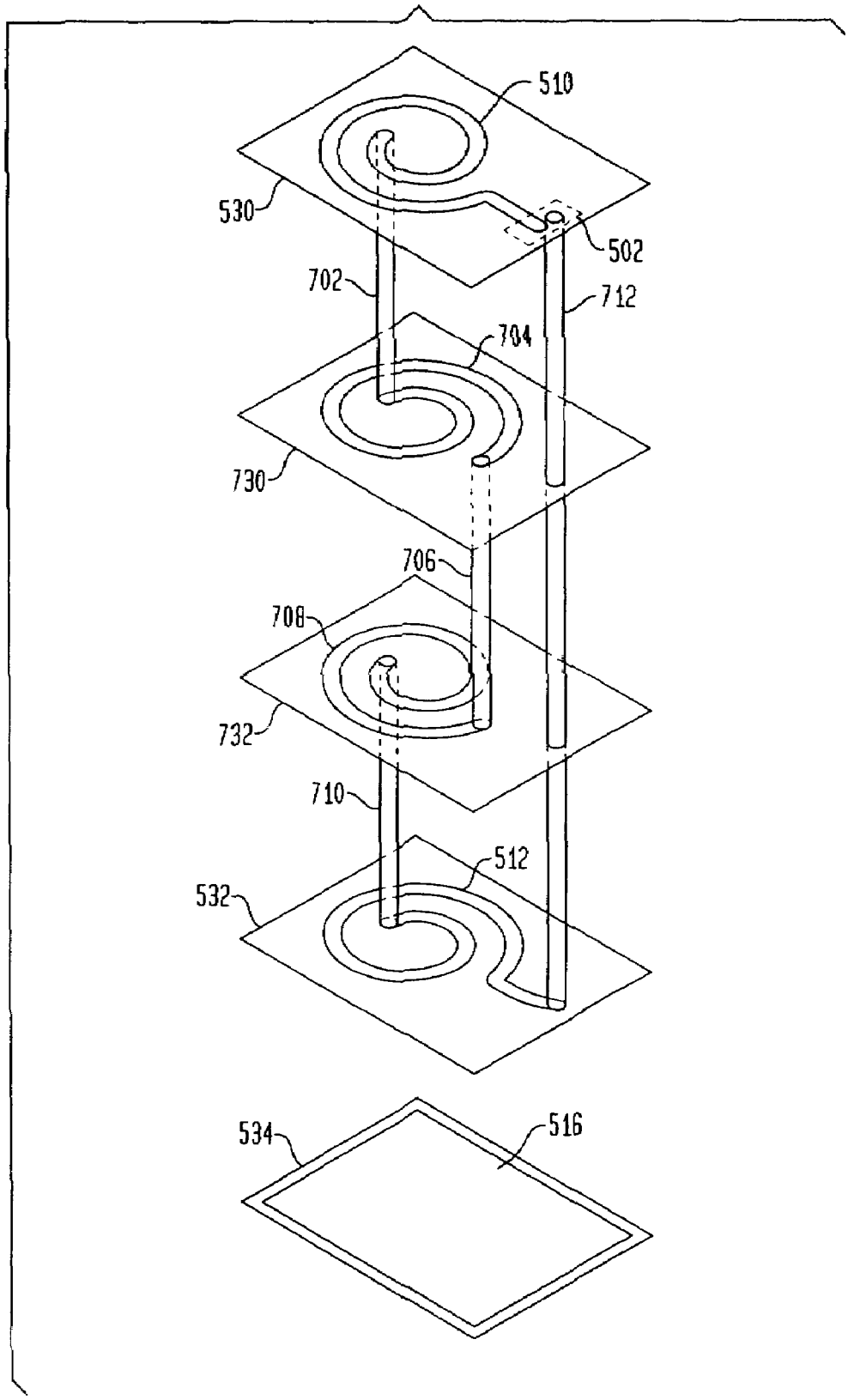

FIG. 7 is a side view of an exemplary five layer implementation of inductor 500. In this implementation, continuing interconnection 514 includes two spiral conductive patterns that are each disposed on a corresponding substrate surface. These conductive patterns are shown in FIG. 7 as patterns 704 and 708, which are disposed on surfaces 730 and 732, respectively.

Continuing interconnection 514 also includes vias 702, 706, 710, and 712. Vias 702 and 710 provide electrical couplings between continuing interconnection 514 and conductive patterns 510 and 512, respectively. In particular, via 702 electrically couples spiral conductive patterns 510 and 704, while via 710 electrically couples spiral conductive patterns 512 and 708. Within continuing interconnection 514, via 706 electrically couples conductive patterns 704 and 708, while via 710 electrically couples conductive patterns 708 and 512.

Shield pattern 516 is disposed on surface 534, which is adjacent to surface 532. As shown in FIG. 7, shield pattern 516 is substantially aligned with conductive pattern 512.

FIG. 8 provides a second view of the five layer inductor implementation described with reference to FIG. 7.

As described above, inductor 500 may include a plurality of conductive patterns. FIGS. 5,6, and 8 illustrate these patterns as having curved spiral shapes. However, these patterns may also have other spiral shapes. Accordingly, FIGS. 9–10 are views of exemplary spiral shapes. It is important to note that the present invention is not limited to these illustrated shapes. Other shapes may be employed without departing from the spirit and scope of the present invention.

Figure 9A:
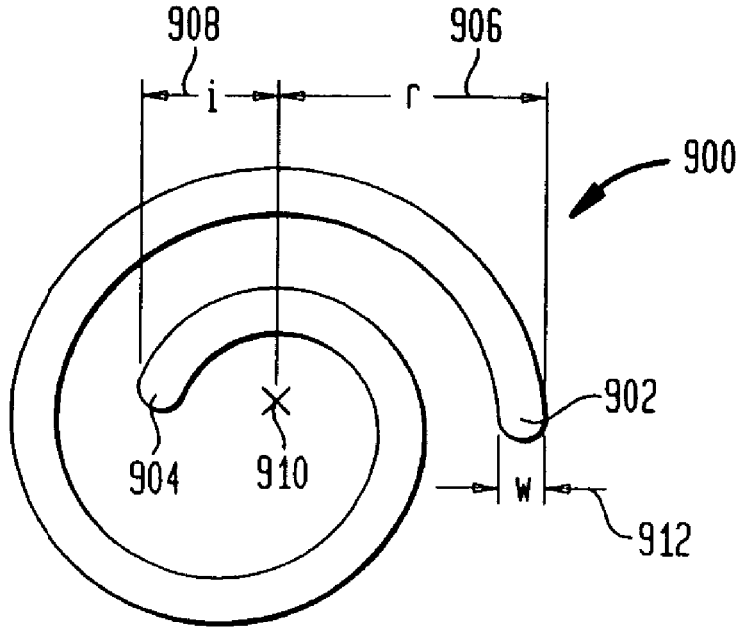
FIGS. 9A and 9B are views of an exemplary round spiral shape.
Figure 9B:
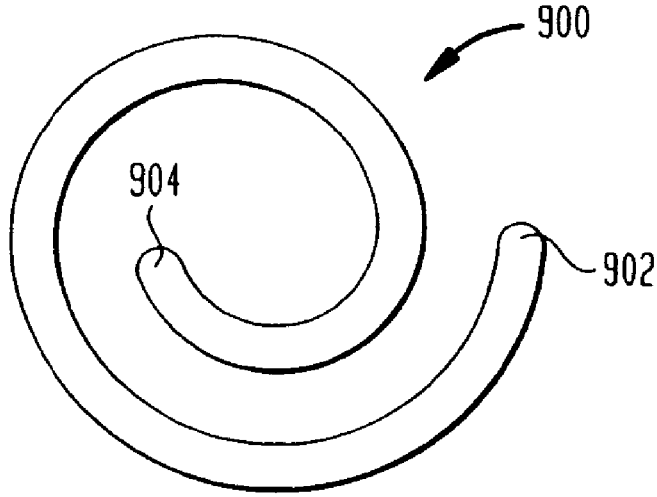

FIGS. 9A and 9B are top views of an exemplary round spiral shape 900. FIG. 9A illustrates a counterclockwise orientation of spiral shape 900, while FIG. 7B illustrates a clockwise orientation of spiral shape 900. Spiral shape 900 has an outer end 902 and an inner end 904.

Orientation of spiral shape 900 is determined according to the path along spiral shape 900 from outer end 902 to inner end 904. As shown in FIGS. 9A and 9B, this path is a variable radius curve of approximately one and a half turns. In FIG. 9A, the path from outer end 902 to inner end 904 follows a counterclockwise oriented contour. In contrast, the path in FIG. 9B from outer end 902 to inner end 904 follows a clockwise oriented contour.

Spiral shape 900 has an outer radius 906 (designated by the symbol r) and an inner radius 908 (designated by the symbol i). As shown in FIG. 9A, r, is measured from a center point 910 to an outermost portion of outer end 902. Similarly, i, is measured from center point 910 to an outermost portion of inner end 904. Preferably, i is less than twenty percent of r. However, the present invention includes spiral patterns where i is larger than this value.

Between i and r is a mean radius, a, that is an average distance from center point 910 to outermost portions of spiral shape 900. Furthermore, spiral shape 900 has a line width 912 (designated by the symbol w) that indicates the width of the path of spiral shape 900.

Figure 10A:
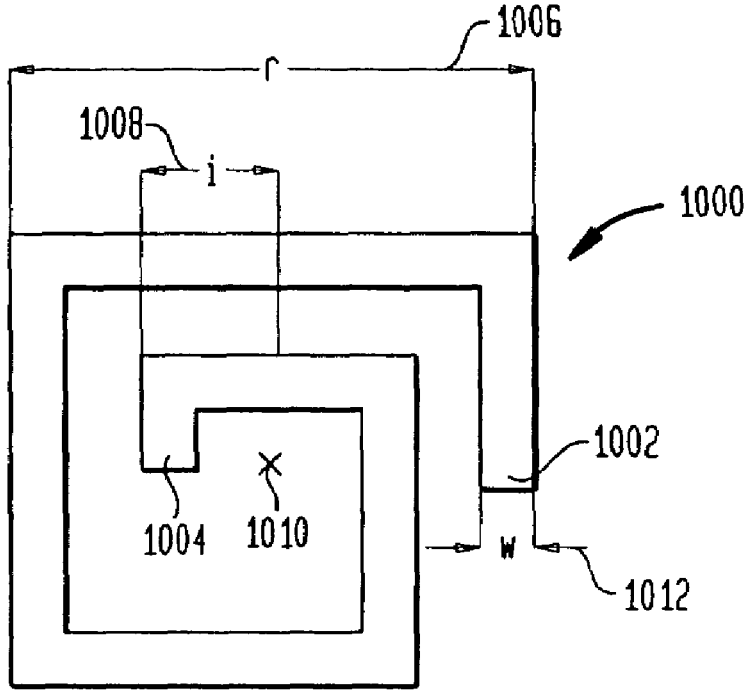
FIGS. 10A and 10B are views of an exemplary square spiral shape.
Figure 10B:
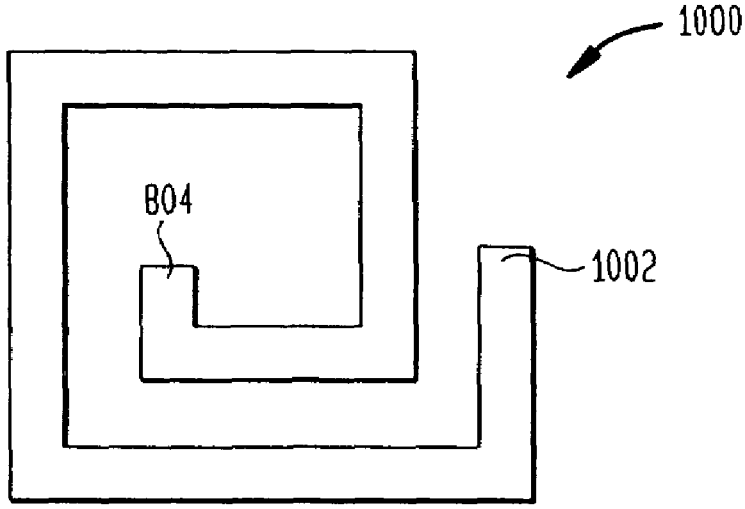

FIGS. 10A and 10B are top views of an exemplary square spiral shape 1000 having an outer end 1002 and an inner end 1004. FIG. 10A illustrates a counterclockwise orientation of spiral shape 1000, while FIG. 10B illustrates a clockwise orientation of spiral shape 1000. Like spiral pattern 900, spiral pattern 1000 includes a path between ends 1002 and 1004 that is approximately one and a half turns. Although FIGS. 10A and 10B show substantially square patterns, the present invention may also include any rectangular shape.

Like spiral shape 900, spiral shape 1000 has an outer radius 1006 (designated by the symbol r) and an inner radius 1008 (designated by the symbol i). As shown in FIG. 10A, r, is measured from a center point 1010 to an outermost portion of outer end 1002. Similarly, i, is measured from center point 1010 to an outermost portion of inner end 1004. Between i and r is a mean radius, a, that is an average distance from center point 1010 to outermost portions of spiral shape 1000. Furthermore, spiral shape 1000 has a line width 1012 (designated by the symbol w) that indicates the width of the path of spiral shape 1000.

Figure 11A:
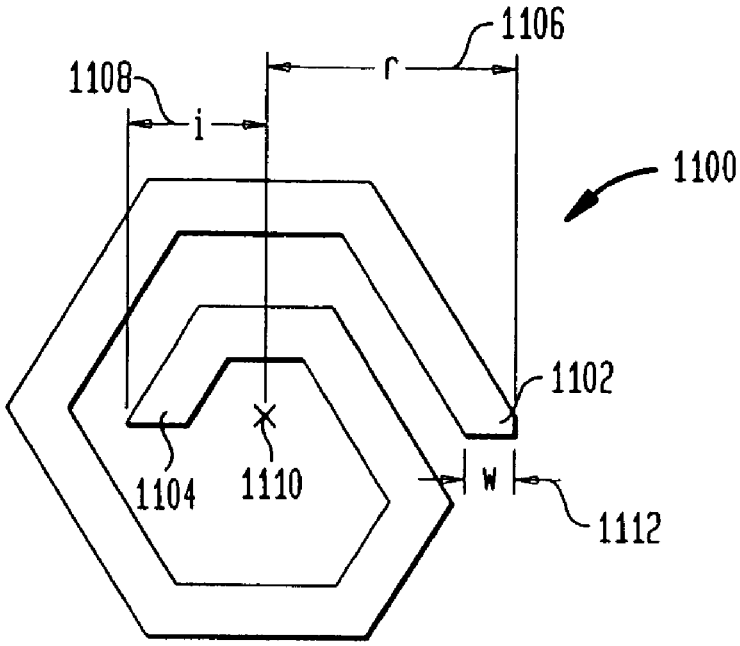
FIGS. 11A and 11B are views of an exemplary hexagonal spiral shape.
Figure 11B:
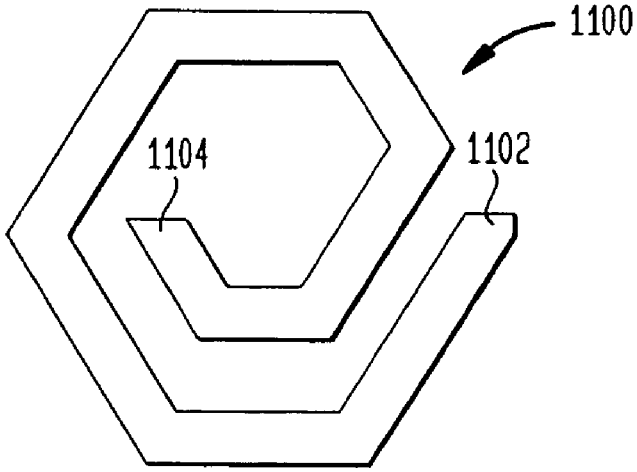

FIGS. 11A and 11B are views of counterclockwise and clockwise orientations for an exemplary hexagonal spiral shape 1100. Like spiral shapes 900 and 1000, hexagonal spiral shape 1100 has an outer end 1102 and an inner end 1104. The path along spiral shape 1100 that is taken from outer end 1102 to inner end 1104 determines whether spiral shape 1100 has a counterclockwise or a clockwise orientation. FIG. 11A shows spiral shape 1100 having a counterclockwise orientation, while FIG. 11B shows spiral shape 1100 having a clockwise orientation.

Like spiral shapes 900 and 1000, spiral shape 1100 has an outer radius 1106 (designated by the symbol r) and an inner radius 1108 (designated by the symbol i). As shown in FIG. 11A, r, is measured from a center point 1110 to an outermost portion of outer end 1102. Similarly, i, is measured from center point 1110 to an outermost portion of inner end 1104. Between i and r is a mean radius, a, that is an average distance from center point 1110 to outermost portions of spiral shape 1100. Furthermore, spiral shape 1100 has a line width 1112 (designated by the symbol w) that indicates the width of the path of spiral shape 1100.

Figure 12A:
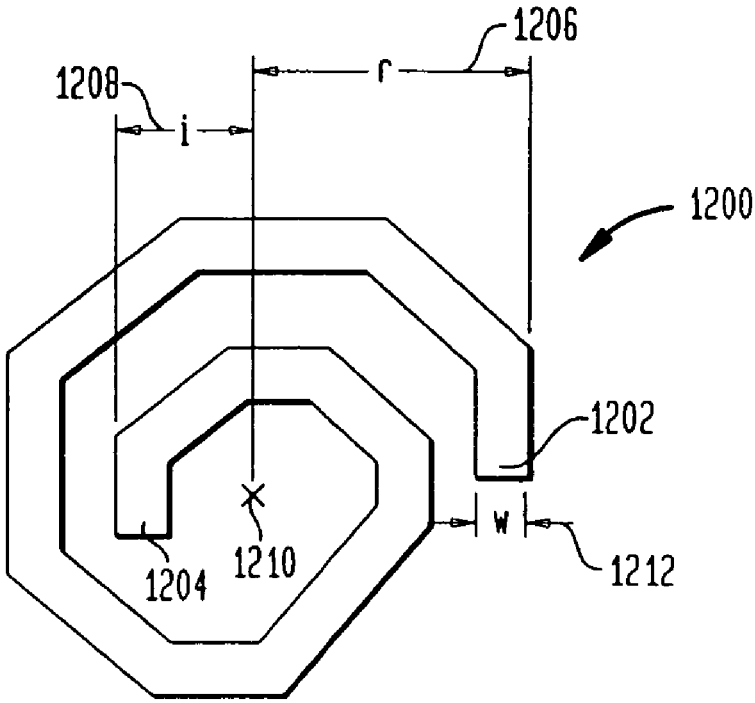
FIGS. 12A and 12B are views of an exemplary octagonal spiral shape.
Figure 12B:
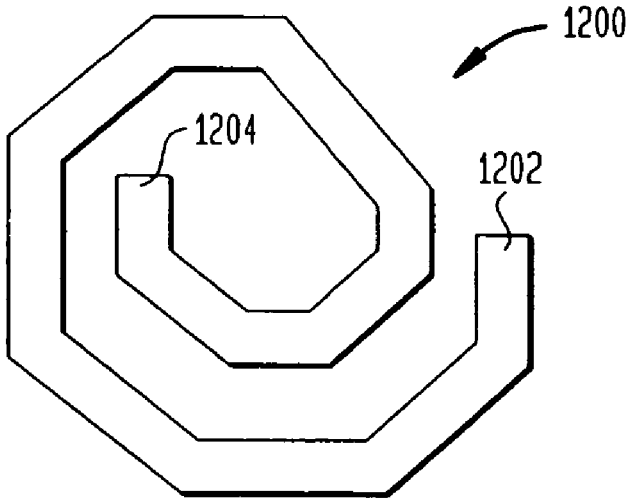

FIGS. 10A and 10B are views of an exemplary octagonal spiral shape 1200 that, like shapes 900, 1000, and 1100, has an outer end 1202 and an inner end 1204. The path from outer end 1202 to inner end 1204 determines the orientation of spiral shape 1202. FIG. 12A shows spiral shape 1200 having a counterclockwise orientation, while FIG. 12B shows spiral shape 1200 having a clockwise orientation.

Similar to spiral shapes 900, 1000, and 1100, spiral shape 1200 has an outer radius 1206 (designated by the symbol r) and an inner radius 1208 (designated by the symbol i). As shown in FIG. 12A, r, is measured from a center point 1210 to an outermost portion of outer end 1202. Similarly, i, is measured from center point 1210 to an outermost portion of inner end 1204. Between i and r is a mean radius, a, that is an average distance from center point 1210 to outermost portions of spiral shape 1200. Furthermore, spiral shape 1200 has a line width 1212 (designated by the symbol w) that indicates the width of the path of spiral shape 1200.

The orientation of spiral conductive patterns in multiple layer inductor 500 will now be described. As described above with reference to FIGS. 5–6, inductor 500 includes a plurality of surfaces arranged in a layered pattern, where spiral conductive patterns are disposed on two or more of these surfaces. For example, the inductor 500 implementation shown in FIGS. 6A and 6B includes spiral conductive patterns 510 and 512 that are disposed on surfaces 530 and 532, respectively. For this implementation, these layers are adjacent. As shown in FIG. 6A, spiral conductive pattern 510 has a clockwise orientation, while spiral conductive pattern 512 has a counterclockwise orientation. Thus, embodiments may include spiral conductive patterns having alternating orientations according to substrate layer.

The implementation of inductor 500 shown in FIGS. 7A and 7B provides another illustration of this alternating orientation feature. In this implementation, spiral conductive patterns 510, 708, and 512 are disposed on adjacent surfaces 530, 730, and, 532, respectively. As shown in FIG. 7A, spiral conductive pattern 510 has a clockwise orientation, and spiral conductive pattern 708 has a counterclockwise orientation. Furthermore, in this implementation, spiral conductive pattern 512 has a clockwise orientation.

A further example of this alternating orientation feature is described with reference to the implementation shown in FIG. 8. In this implementation, spiral conductive patterns 510, 804, 808, 812, and 512 are disposed on adjacent surfaces 530, 830, 832, 834, and 532, respectively. In this implementation, these conductive patterns may have orientations based on the layer-based alternating orientation scheme described above. For example, patterns 510, 808, and 512 may each have a clockwise orientation, while patterns 804 and 812 each have a counterclockwise orientation. Similarly, the implementation of FIG. 8 may alternatively employ the opposite orientation relationship.

Figure 14:
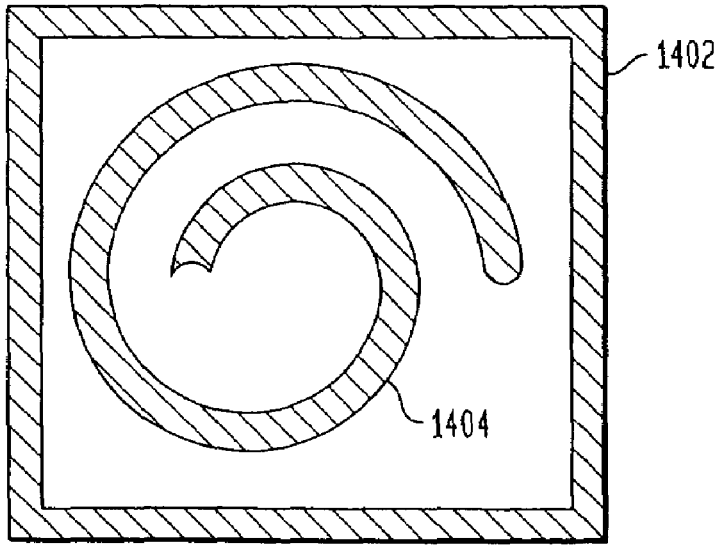

As described above, multiple layer inductor 500 may include an optional bottom shield pattern 516 and/or an optional top shield pattern 518. To further reduce unwanted electromagnetic interaction between inductor 500 and other electronic components (not shown), inductor 500 may also include side shield patterns disposed on each surface that includes a spiral conductive pattern. FIGS. 11 and 14 provide views of exemplary side shields.

Figure 13:
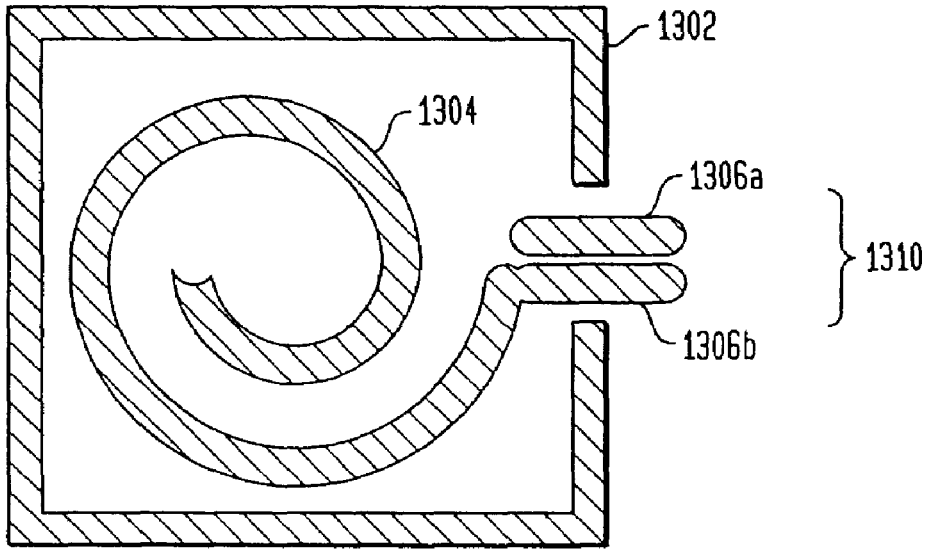
FIGS. 13 and 14 are views of exemplary side shield patterns.

FIG. 13 is a top view of a side shield 1302 disposed on a surface having a spiral conductive pattern 1304, a first terminal 1306*a* and a second terminal 1306*b*. Side shield 1302 does not completely surround pattern 1304 and terminals 1306. Instead, side shield 1302 provides an opening 1310 that enables the coupling of traces (not shown) to terminals 1306.

Spiral pattern 1304 and terminals 1306 are similar to spiral conductive pattern 510, terminal 504, and terminal 506, as described herein with reference to FIGS. 5–6. Accordingly, implementations of inductor 500 may include a side shield, such as side shield 1302, to surround spiral conductive pattern 510 in the manner shown in FIG. 13. Such side shields may have a voltage potential, such as ground.

FIG. 14 is a top view of a side shield 1402 disposed on a surface that also has a spiral conductive pattern 1404, but no terminals. Side shield 1402 completely surrounds conductive pattern 1404. One or more of the spiral conductive patterns of multiple layer inductor 500 may be surrounded by a side shield, such as side shield 1402, having a voltage potential, such as ground.

III. Inductor Design Procedure

The inductance of multiple layer inductor 500 can be mathematically estimated through Equation (1), below.

$$L = \frac{37.5\mu_o n^2 a^2}{22r - 14a} \tag{1}$$

In Equation (1), L represents the inductance of multiple layer inductor 500 in Henries, $\mu_o$ represents the permeability of free space, n represents the total number of turns in all of the spiral conductive patterns of inductor 500, r represents the outer radius for each of the spiral conductive patterns in meters, and a represents the mean radius for each of the spiral conductive patterns in meters. Further explanation Equation (1) is provided in H. A. Wheeler, "Simple Inductance Formulas for Radio Coils," *IRE Proceedings,* 1928, pg. 1398, as quoted in T. H. Lee, The Design of CMOS Radio Frequency Integrated Circuits, Cambridge University Press, 1998, pp. 48–49. These documents are incorporated herein by reference in their entirety.

Figure 15:
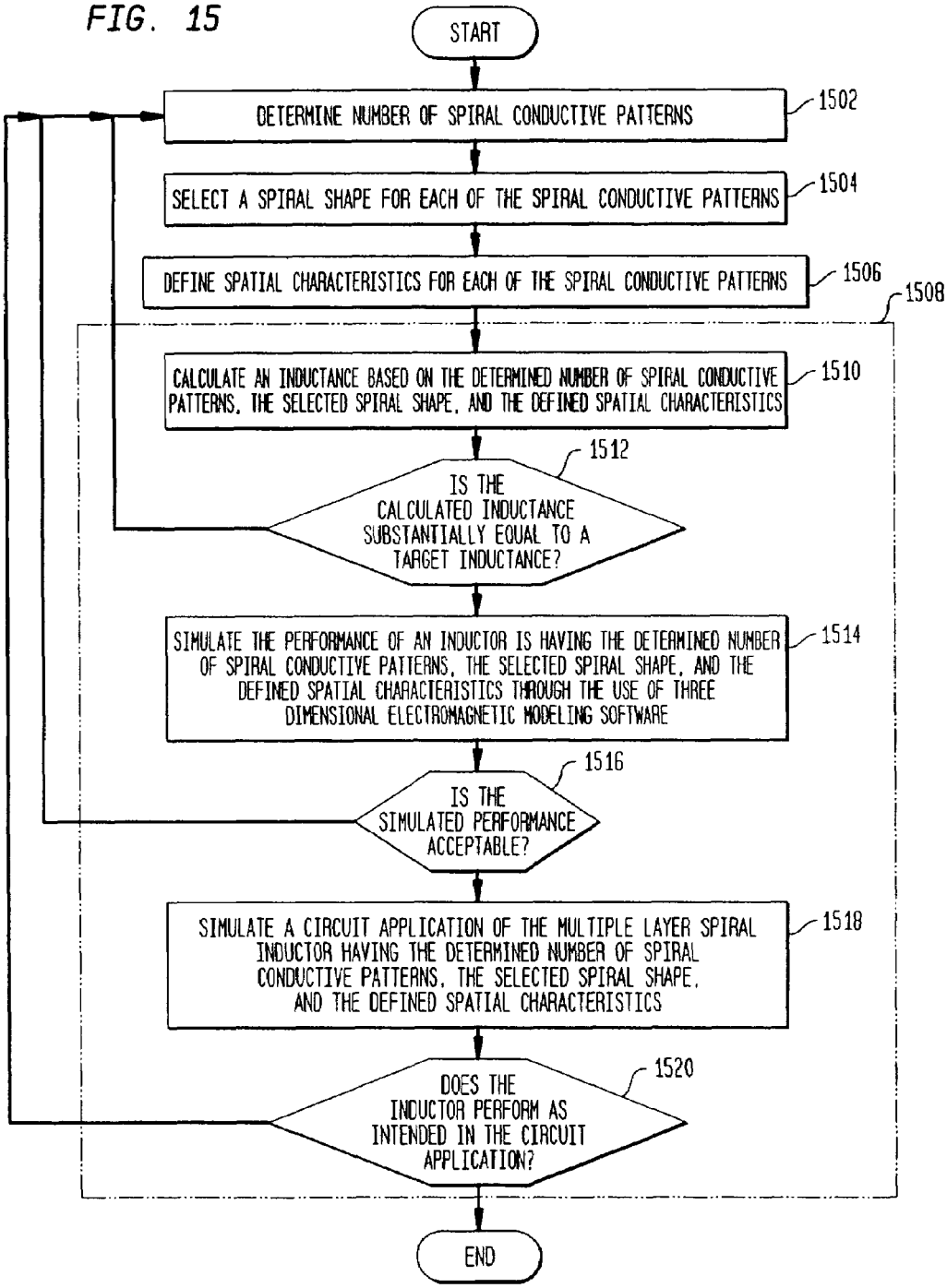
FIG. 15 is a flowchart of an inductor design procedure.

The present invention includes a procedure of designing multiple layer inductor 500. This procedure involves the use of Equation (1) to generate inductor characteristics according to a target inductance. FIG. 15 is a flowchart illustrating an operational sequence of this procedure. This sequence begins with a step 1502. In step 1502, a number of spiral conductive patterns is determined for inductor 500. This number may be as large as the number of substrate layers. However, when bottom and/or top shields are desired, this number will be one or two layers less to accommodate the bottom and/or top shields.

Next, in a step 1504, a spiral shape is selected. As described above with reference to FIGS. 9–10, exemplary shapes include round spiral shapes, square spiral shapes, rectangular spiral shapes, hexagonal spiral shapes, and octagonal spiral shapes. However, other shapes may be selected.

A step 1506 follows step 1504. In this step, the spatial characteristics of each of the spiral conductive patterns is defined. These spatial characteristics include line width, w, outer radius, r, inner radius i, and mean radius, a, as expressed above in Equation (1). The range of available line widths and spiral sizes is determined by various factors, such as the process employed to manufacture the substrate (e.g., the PCB).

Next, a step 1508 verifies the performance of a multiple layer spiral inductor having the determined number of spiral conductive patterns, the selected spiral shape, and the defined spatial characteristics. FIG. 15 shows that step 1508 includes steps 1510 through 1520.

In step 1510, an inductance is calculated an inductance based on the determined number of spiral conductive patterns, the selected spiral shape, and the defined spatial characteristics. This calculation may be performed according to Equation (1). In step 1512, it is determined whether the calculated inductance is substantially equal to a target inductance. If so, then the procedure continues to step 1514. Otherwise, the procedure returns to step 1502, so that steps 1502 through 1506 may be repeated.

Next, in step 1514, the performance of inductor 500 is simulated through the use of three dimensional electromagnetic modeling software. Suitable modeling software products include IE3D by Zeland Software, Inc. of Fremont, Calif., and Microwave Office by Applied Wave Research Inc. of El Segundo, Calif. In step 1516, it is determined whether the simulated performance is acceptable. If so, then the procedure continues to step 1518. Otherwise, the procedure returns to step 1502, where Equation (1) should be used as a guide in this iterative process to indicate how the inductor dimensions and number of turns should be modified to obtain the desired inductance.

In step 1518, a circuit application for the inductor implementation may be simulated to determine whether the circuit exhibits desired performance characteristics. As an example, this step may comprise simulating a diplexer circuit (described below with reference to FIGS. 16 and 17) using a radio frequency (RF) circuit simulator. Examples of RF circuit simulators include MMICAD by Optotek Ltd. of Kanata, Ontario Canada, Microwave Office by Applied Wave Research Inc. of El Segundo, Calif., and Touchstone and ADS/MDS by Agilent Technologies, Inc. of Palo Alto, Calif.

The inductors may be modeled in this step as S-parameter tables, or equivalent circuits, derived from the software used in step 1516. An exemplary performance characteristic that may be analyzed in this step is the diplexer frequency response. In step 1520, it is determined whether the performance characteristics are acceptable. If so, then the procedure is complete. Otherwise, the procedure returns to step 1502.

IV. Exemplary Application Environment

Figure 16:
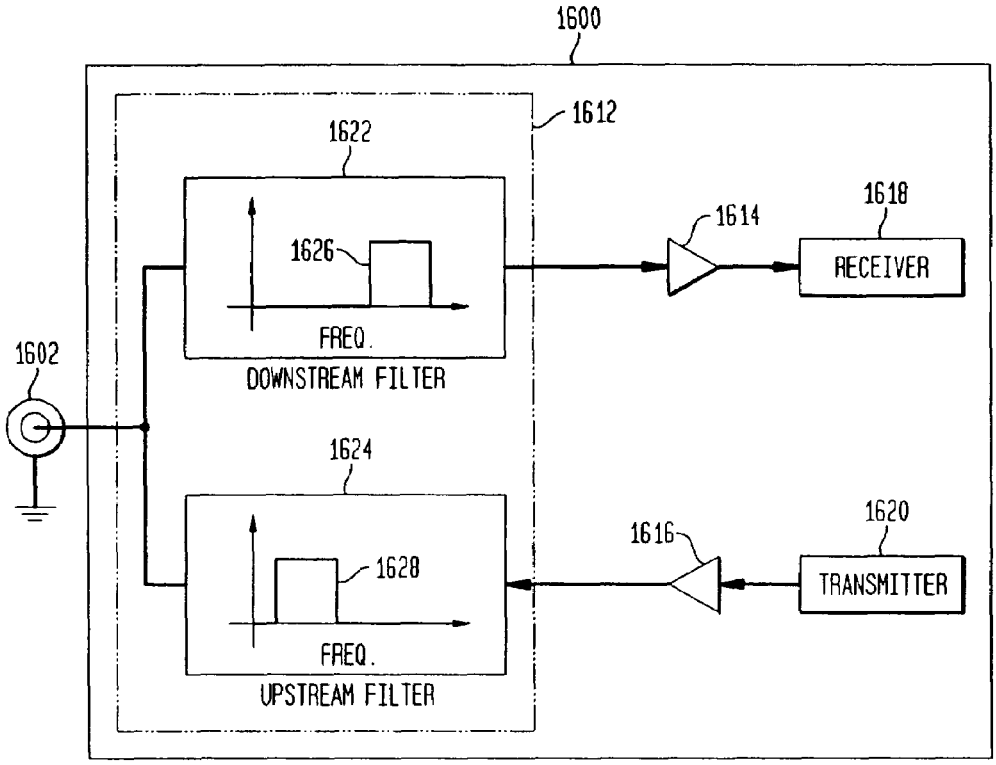
FIG. 16 is a block diagram of an exemplary communications node.

The description now turns to an example environment in which the invention may be implemented. The present invention is particularly useful in communications nodes. FIG. 16 illustrates an exemplary communications node 1600 (also referred to herein as communications device 1600). Communications node 1600 may be a cable modem diplexer, or other devices, as would be apparent to persons skilled in the relevant art(s). Communications node 1600 includes a diplexer 1612, a receiving amplifier 1614, a transmitting amplifier 1616, a receiver 1618, and a transmitter 1620. Receiver 1618 may include a television tuner.

Communications node 1600 exchanges signals with a shared medium 1602. Shared medium 1602 provides node 1600 with a communications bandwidth (e.g., a portion of the electromagnetic spectrum) for the exchange of signals. As shown in FIG. 16, a coaxial cable is an exemplary implementation of shared medium 1602. However, shared medium 1602 may include other implementations, such as a wireless radio frequency (RF) spectrum. In this wireless RF implementation, communications node 100 includes an antenna (not shown) coupled to diplexer 1612 that exchanges RF signals with RF spectrum 1602.

This exchange of signals is performed according to a full-duplex approach, where communications node 1600 transmits signals over a first portion of the communications bandwidth and a receives signals over a second portion of the communications bandwidth. These first and second portions of the bandwidth are referred to herein as an upstream portion and a downstream portion, respectively.

Diplexer 1612 enables this full-duplex functionality. Namely, diplexer 1612 isolates receiver 1618 from receiving signals originated by transmitter 1620. Furthermore, diplexer 1612 protects sensitive circuitry within receiver 1618 from powerful signals that are originated by transmitter 1620 and amplified by transmitting amplifier 1616.

Diplexer 1612 includes a downstream filter 1622 and an upstream filter 1624. As illustrated in FIG. 16, both downstream filter 1622 and upstream filter 1624 pass signals having frequencies within bandwidths 1626 and 1628, respectively. Bandwidth 1626 is within the downstream portion of the shared medium 1602 spectrum, while bandwidth 1628 is within the upstream portion of the shared medium 1602 spectrum.

Diplexer 1612 may be implemented on a printed circuit board (PCB) that includes various elements. Examples of these elements include integrated circuit(s), RF and low-frequency connectors, and discrete electronic components. These elements may be surrounded by a housing made of a conductive material, such as sheet metal. For such PCB implementations, filters 1622 and 1624 include inductors and capacitors that are assembled upon the PCB.

Figure 17:
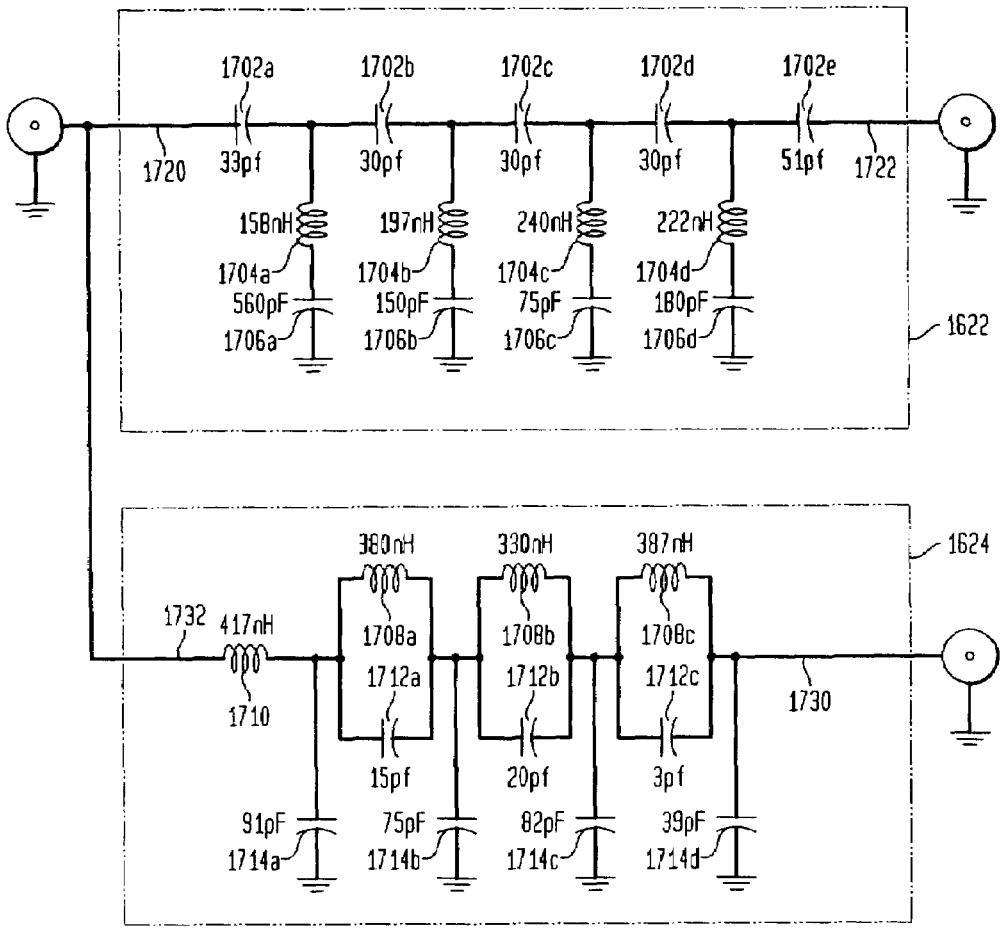
FIG. 17 is a circuit schematic illustrating implementations of upstream and downstream filters.

FIG. 17 is a circuit schematic illustrating implementations of filters 1622 and 1624. As shown in FIG. 17, both downstream filter 1622 and upstream filter 1624 include a plurality of capacitors and inductors. Downstream filter 1622 filters signals received at a node 1720 and outputs these filtered signals at an output node 1722. In contrast, upstream filter 1624 filters signals received at an input node 1730 and outputs these filtered signals at an output node 1732.

Downstream filter 1622 includes a network of capacitors 1702*a–e* and 1706*a–d*, and inductors 1704*a–d*. This network provides a pass band from 54 to 860 MHz or higher. Upstream filter 1624 includes a network of capacitors (1712*a–c*, 1714*a–c*, and 1714*a–d*) and inductors (1708*a–c* and 1710). This network provides a pass band from 0 to 42 MHz.

Figure 18A:
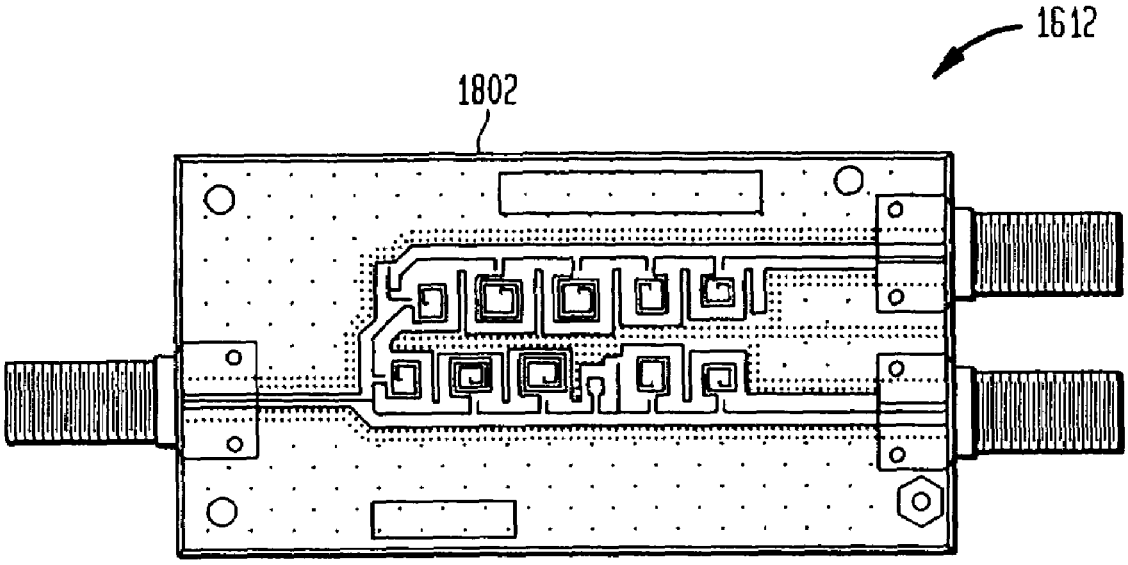
FIGS. 18A and 18B are views of a printed diplexer.
Figure 18B:
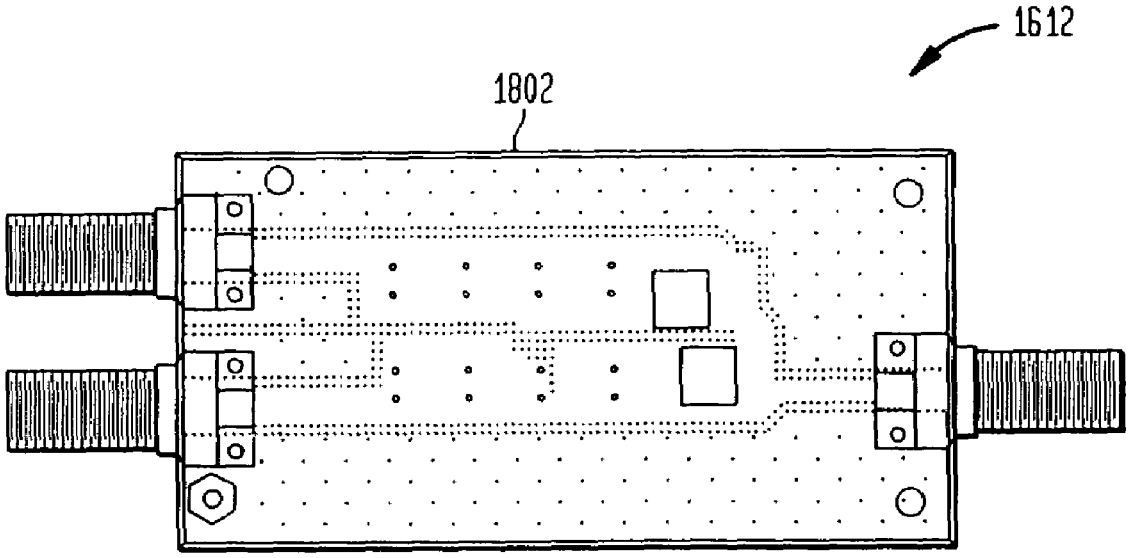

The inductors in the circuit of FIG. 17 may be implemented using implementations of multiple layer inductor 500. As such, FIGS. 18A and 18B are views of diplexer 1612 implemented on a PCB 1802 that include a plurality of multiple layer inductors 500. These diplexers do not include an attached metallic housing.

As described above, these inductor implementations advantageously provide smaller footprints than single layer printed inductors. Furthermore, such multiple layer inductors are less costly than discrete inductors. In addition, the aforementioned shielding features of these multiple layer inductors allows minimal spacing between components without electromagnetic interference and without the attachment of a bulky metallic housing. Therefore, the present invention enables a low cost implementation of electronic applications on smaller substrates.

V. Conclusion

While various embodiments of the present invention have been described above, it should be understood that they have been presented by way of example only, and not limitation. For example, the present invention may be used for applications other than diplexers. One such application is an impedance matching network.

In addition, various aspects of the present invention are described above in the context of a plurality of spiral conductive patterns disposed on adjacent surfaces. However, the present invention may include surfaces that do not include spiral conductive patterns between surfaces having spiral conductive patterns.

Furthermore, the invention is not limited to the exemplary implementations described above having two, three, and four layers of spiral conductive patterns. In fact, any number of such layers may be employed. Also, even though FIGS. 9–10 show spiral patterns having approximately one and a half turns, the present invention may employ spiral patterns having any number of turns.

Finally, it will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined only in accordance with the following claims and their equivalents.

The invention claimed is:

1. A filter for use in a communications device, comprising:

a first inductor coupled between a filter input and a first node;

a first capacitor coupled between the filter input and a first supply voltage;

a second capacitor coupled in parallel with the first inductor;

a third capacitor coupled between the first node and the first supply voltage; and a second inductor coupled between the first node and a second node, wherein the first inductor is a multiple layer inductor having a plurality of layers, each layer having a first surface and a second surface, and wherein the multiple layer inductor includes:

a first conductive pattern on the first surface of a first layer of the plurality of layers;

a second conductive pattern on the first surface of a second layer of the plurality of layers;

an interconnection coupled to said first and second conductive patterns; and a first conductive side shield pattern and a second conductive side shield pattern disposed on respective perimeters of the first and second layers.

2. The filter of claim 1, wherein the multiple layer inductor further includes:

a terminal on the first surface of the first layer, wherein the terminal is coupled to the second conductive pattern.

3. The filter of claim 1, wherein the multiple layer inductor further includes:

a third conductive shield pattern on a first surface of a third layer of the plurality of layers, wherein the third layer is adjacent to the second layer.

4. The filter of claim 3, wherein the multiple layer inductor further includes:

a fourth conductive shield pattern on a first surface of a fourth layer of the plurality of layers, wherein the fourth layer is adjacent to the first layer.

5. The filter of claim 1, wherein the interconnection comprises:

a first via coupled to the first and second conductive patterns; and a second via coupled to the second conductive pattern and the terminal.

6. The filter of claim 1, wherein the second inductor is a multiple layer inductor.

7. The filter of claim 1, wherein the communications device is a television tuner.

8. The filter of claim 1, wherein the communications device is a cable modem.

9. A filter for use in a communications device, comprising:

a first capacitor coupled between a filter input and a first node;

a first inductor coupled between the first node and a second node;

a second capacitor coupled between the second node and a first supply voltage; and a third capacitor coupled between the first node and a third node, wherein the first inductor is a multiple layer inductor having a plurality of layers, each layer having a first surface and a second surface, and wherein the multiple layer inductor includes:

a first conductive pattern on the first surface of a first layer of the plurality of layers;

a second conductive pattern on the first surface of a second layer of the plurality of layers;

an interconnection coupled to said first and second conductive patterns; and a first conductive shield pattern and a second conductive side shield pattern disposed on respective perimeters of said first and second layers.

10. The filter of claim 9, wherein the multiple layer inductor further includes:

a terminal on the first surface of the first layer, wherein the terminal is coupled to the second conductive pattern.

11. The filter of claim 9, wherein the multiple layer inductor further includes:

a third conductive shield pattern on a first surface of a third layer of the plurality of layers, wherein the third layer is adjacent to the second layer.

12. The filter of claim 9, wherein the multiple layer inductor further includes:

a fourth conductive shield pattern on a first surface of a fourth layer of the plurality of layers, wherein the fourth layer is adjacent to the first layer.

13. The filter of claim 9, wherein the interconnection comprises:

a first via coupled to the first and second conductive patterns; and a second via coupled to the second conductive pattern and the terminal.

14. The filter of claim 9, wherein the communications device is a television tuner.

15. The filter of claim 9, wherein the communications device is a cable modem.

* * * * *